United States Patent [19]

Raske

[11] 4,176,695

[45] Dec. 4, 1979

[54] LEVER HOLDING DEVICE FOR FUEL DISPENSING NOZZLE ASSEMBLY

[76] Inventor: Walter O. A. Raske, 9051 Katy Freeway, Houston, Tex. 77024

[21] Appl. No.: 928,087

[22] Filed: Jul. 26, 1978

[51] Int. Cl.[2] ..... B65B 3/04; G05G 5/06

[52] U.S. Cl. ..... 141/96; 141/392; 251/90; 251/111; 74/526

[58] Field of Search ..... 141/1, 198, 206–229, 141/392, 94, 95, 96; 251/111, 284, 285, 90, 101, 112; 24/3 E, 3 R, 73 B; 74/526

[56] References Cited

U.S. PATENT DOCUMENTS 4,095,629 6/1978 Jordan ..... 141/392

*Primary Examiner*—Houston S. Bell, Jr.

*Attorney, Agent, or Firm*—Hyer, Matthews, Reiter & Jackson

[57] ABSTRACT

There is disclosed a device for holding the lever of a nozzle assembly in a position to open a valve controlling the flow of fuel through a passageway in the handle of the assembly.

3 Claims, 3 Drawing Figures

LEVER HOLDING DEVICE FOR FUEL DISPENSING NOZZLE ASSEMBLY

This invention relates generally to a nozzle assembly for use in dispensing fuel from an upright pump body through a flexible hose connecting the pump body with the nozzle assembly. More particularly, it relates to improvements in a device for releasably holding a lever of such an assembly in valve opening position so as to permit a motorist or other operator of the assembly to go about other chores. This device is especially useful in the dispensing of fuel at "self service" filling stations, where the nozzle assembly is often not provided with means for latching the lever in its valve opening position, as is normally found in the case of "full service" service station facilities.

Davis U.S. Pat. No. 2,320,033 shows a nozzle assembly for dispensing fuel into a tank through a flexible hose leading from a pump body to the assembly. As is conventional in this art, the assembly includes a spout which may be inserted into the inlet to the tank, and a handle having a passageway connecting the spout with the hose. Flow through the passageway is controlled by a valve in the passageway and a lever beneath the handle which is adapted to be raised by the operator to open the valve.

Normally, the lever is protected from automatic displacement by a guard which includes a portion beneath the lever. As shown in Gravelle U.S. Pat. No. 2,528,747, a stepped latch may be pivotally supported on the guard in position to receive and hold the free end of the lever in valve opening position. When the nozzle assembly also has means for automatically shutting off the flow of fuel when the tank is full, as shown, for example, in the above-mentioned Davis patent, the operator may leave the assembly unattended as he goes about other chores.

However, with the current trend toward providing lower gasoline costs, many stations are "self service" type, and most of these, while utilizing an automatic nozzle assembly as in the Davis U.S. Pat. No. 2,320,033, have removed or do not include the stepped latch used to retain the regulating lever in its upper, valve opening position. The absence of such a means, whereby the nozzle assembly may be left with the valve in open position, prevents the motorist from otherwise routinely servicing his automobile as the tank of his car is being filled.

A device has been recently introduced to the market which the motorist may install on the assembly in order to hold the lever in its raised position during filling of the automobile fuel tank. This device comprises a thin sheet of hard plastic material formed in a "C" or "U" shape having one leg for hooking over the top of the handle of the nozzle assembly and other leg or finger arranged to swing beneath and tightly engage the lever in its raised position. However, there is nothing to prevent this device from remaining installed on the nozzle assembly when the tank is filled, and the nozzle assembly is returned to supported position on the pump body. Consequently, it may be left behind as the motorist drives off after servicing his automobile.

It is therefore an object of the present invention to provide a device which, in addition to retaining the lever in its raised position for dispensing fuel, while the motorist checks the engine oil, battery water, tire pressure, washes the windshield, etc. and otherwise services his automobile, also alerts him to the fact that he has not removed it from the nozzle assembly should this be the case, and which is preferably positively removed from the assembly as the assembly is returned to supported position on the pump.

Another object is to provide such a device which is of simple and inexpensive construction, and of a size and shape which permits it to be carried by the motorist on his person or in his automobile.

Figure 2:
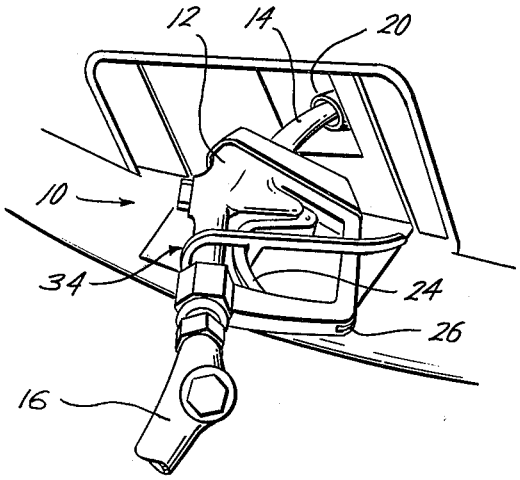
FIG. 2 is a perspective view of the device attached to a typical nozzle assembly having its spout inserted into the fuel tank inlet of an automobile.
Figure 3:
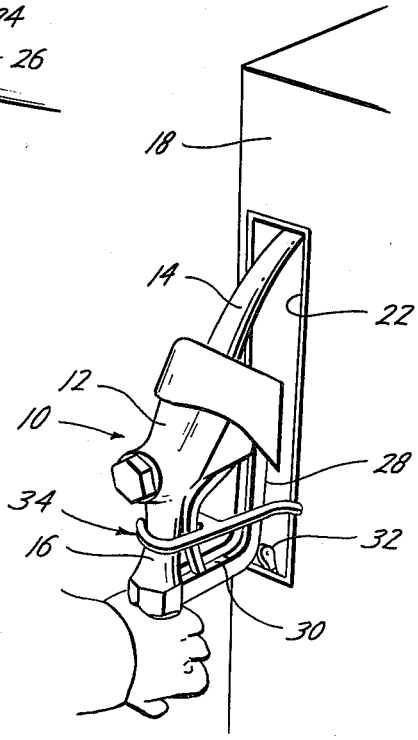
FIG. 3 is a perspective view of the nozzle assembly being returned to supported position on the pump body upon completion of the fuel dispensing operation.

With reference now to the details of the above-described drawings, the nozzle assembly, which is indicated in its entirety by reference character 10, is shown in FIGS. 2 and 3 to comprise a handle 12 having a passageway (not shown) therethrough, connecting at one end with a spout 14 and at its opposite end to a flexible hose 16. The hose in turn leads to a pump (not shown) within an upright body or housing 18 of the type commonly found at service stations. When in use, the spout is inserted into the inlet 20 of the tank, as indicated in FIG. 2, to permit the nozzle assembly to dispense fuel from the pump body into the fuel tank. When not in use, the assembly 10 is supported on a side of the pump body, with its spout 14 within the upper end of a recess 22 in the side of the pump body.

The handle 12 of the assembly includes a valve (not shown) which is of conventional construction, as above described, so as to be moved to a position to open the passageway therethrough by lifting of a lever 24 pivotally mounted on the handle beneath the lower side thereof. Upon return of the lever of its lower position, the valve is adapted to close so as to discontinue the fuel dispensing operation. The lever is protected by a guard 26 which forms a loop beneath the handle and includes a portion 28 beneath the lever 24. The free end of the lever is guided within a slot 30 in the rearward portion of the loop-shaped guard 26.

In using the nozzle assembly, the operator, whether it be the attendant or the motorist owning the automobile, grasps the handle in his hand and raises the lever to valve opening position by means of his fingers. When the dispensing operation is discontinued, the spout 14 is removed from the tank inlet and the assembly as a whole carried by the operator to the pump body 18, where the spout 14 is moved upwardly into the upper end of the recess 22 as shown, and the guard is moved upwardly and downwardly to move slot 30 over a hook 32 on the lower end of the recess. At this time, the nozzle assembly is supported on the pump body with the lower portion 28 of its guard within the recess. As best shown in FIG. 3, the recess 22 is relatively narrow so that its opposite sides fit relatively closely to opposite sides of the guard 28.

Figure 1:
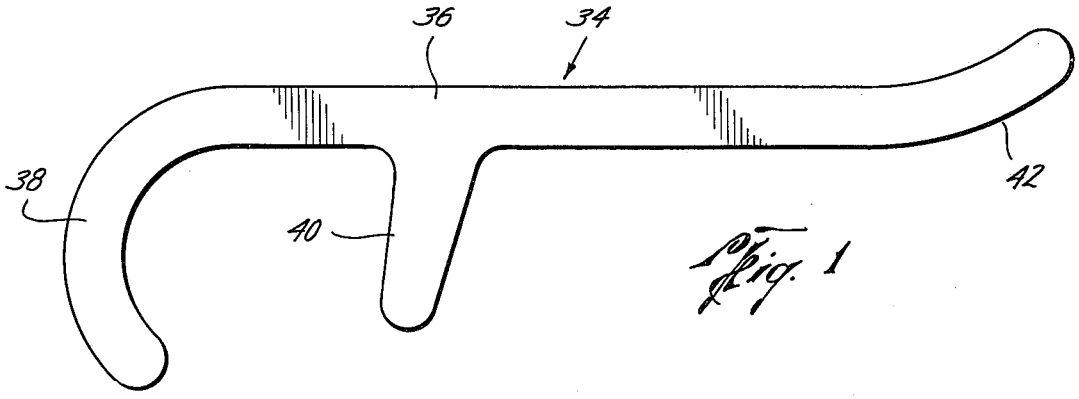
FIG. 1 is a side view of an illustrative embodiment of a lever holding device constructed in accordance with the present invention.

The lever holding device constructed in accordance with the illustrated embodiment of the present invention, and indicated in its entirety by reference character 34, is best shown in FIG. 1 to comprise an elongate base 36 having a first finger 38 projecting laterally from one end thereof, and preferably curved to the radius of the top side of the handle 12 above lever 24 so as to fit closely thereabout. The device also includes a second finger 40 which projects laterally from the elongate base 36 intermediate its ends and is so spaced from the first finger 38 that its surface on the side facing the first finger will engage tightly beneath the lower side of the lever 24 when the first finger is hooked over the handle and the lever has been raised to valve opening position, as shown in FIG. 2. Thus, in order to assemble the device on the nozzle assembly, the operator hooks the first finger 38 onto the top side of the handle, with the base 36 angled outwardly from one side of the nozzle assembly, to permit the base to be swung inwardly toward the handle so as to move the second finger 40 beneath the raised lever, as previously described.

With the device in lever holding position, the valve in the passageway will be held in open position allowing fuel flow therethrough. As long as the nozzle assembly is provided with means of the type previously described for automatically closing the valve when the tank is filled (even though the lever is held in its upper position), the operator is free to attend to other chores without being concerned about returning before the dispensing operation is discontinued.

As shown in FIGS. 2 and 3, when the device is in lever holding position, its base 36 extends downwardly along the side of and beyond the lower portion 28 of the guard 26. More particularly, the end of the base opposite that from which the first finger 38 projects is disposed outwardly of the side edge of body recess 22 as the nozzle assembly is moved into supported position. Thus, the end of the base will engage the side of the pump body as the nozzle assembly is being returned to supported position, so as to alert the operator that the device has not been removed from the nozzle assembly. Furthermore, the end of the base is bent to one side opposite that from which the fingers project so as to provide an outwardly flared surface 42 thereon. In the event the operator does not then remove the device from the nozzle assembly, when it first engages the pump body, but instead continues to move the nozzle toward supported position, and particularly to move the lower portion 28 of the guard into the recess 22, the flared surface 42 will act as a cam surface to force finger 40 from beneath the lever 24, as the hooked arcuate surface on the first finger 38 pivots about the top side of the handle. Consequently, the device is forcibly removed from the nozzle assembly, and caused to fall to the ground to further alert the operator that it should be retrieved for future use.

As shown in the drawings, the base and fingers are disposed in substantially the same plane, and preferably are cut from a single flat sheet of relatively hard, thin plastic material. It will further be appreciated from the drawings that the device is of such size that it may be easily stored and transported by the person using it.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof; it is to be understood that all matter herein set forth or shown in the accompanying drawings is to be interpreted as illustrative and not in a limiting sense.

The invention having been described, what is claimed is:

1. For use in dispensing fuel into a tank from a nozzle assembly through a flexible hose leading from an upright pump body, wherein the nozzle assembly includes a spout for insertion into the inlet of the tank, a handle having a flowway therethrough to connect the hose with the spout and a valve for regulating the flow of fuel through the passageway, a lever mounted beneath the handle in position to be lifted in order to move the valve from closed position to open position, and a guard mounted on the handle having a lower portion extending beneath the lever to prevent its accidental displacement, and wherein the pump body has means thereon to support the nozzle assembly therefrom with the lower portion of the guard adjacent the side of the pump body when the assembly is not in use;

a device for releasably holding the lever in its upper position, comprising a longitudinally extending base, a first finger projecting laterally from one side of the base near one end thereof to permit it to be hooked over the top side of the handle, and a second finger projecting laterally from said one side of the base intermediate its end and being so spaced from the first finger that, with the first finger hooked over the handle, the second finger may be swung into a position in which it is beneath and in tight engagement with the raised lever, said base extending downwardly along one side of and past the lower guard portion, when said second finger is so positioned, so as to dispose its other end in position to engage the side of the pump body as the assembly is being moved into supported position on the pump body, whereby the user of the device is alerted to the fact that said device has not been removed from the assembly.

2. A device of the character defined in claim 1, wherein each of the base and fingers thereof are formed of a relatively thin sheet of plastic material.

3. A device of the character defined in claim 1, wherein the other end of said base has a surface which is flared outwardly toward the side of the base opposite the one side thereof, whereby engagement of said outer end of the base with the side of the pump body adjacent the recess therein, upon return of the assembly to supported position, will force the second finger to swing out of lever engaging position.

* * * * *